United States Patent [19]

Komatsu et al.

[11] Patent Number: 4,639,363

[45] Date of Patent: Jan. 27, 1987

[54] PROCESS FOR PREPARING AMORPHOUS PHASES OF INTERMETALLIC COMPOUNDS BY A CHEMICAL REACTION

[75] Inventors: Masao Komatsu, Higashi-Osaka; Hiroshi Fujita, Ibaraki, both of Japan

[73] Assignee: Osaka University, Suita, Japan

[21] Appl. No.: 711,442

[22] Filed: Mar. 12, 1985

[30] Foreign Application Priority Data

Sep. 14, 1984 [JP] Japan ..... 59-191643

[51] Int. Cl.[4] ..... C01B 6/24

[52] U.S. Cl. ..... 423/644; 148/20.3; 148/403; 420/900

[58] Field of Search ..... 423/644; 148/20.3, 403; 420/900

[56] References Cited

U.S. PATENT DOCUMENTS 4,231,816 11/1980 Cuomo et al. ..... 148/403

FOREIGN PATENT DOCUMENTS 8402926 8/1984 World Int. Prop. O. ..... 148/403

*Primary Examiner*—H. T. Carter

*Attorney, Agent, or Firm*—Spencer & Frank

[57] ABSTRACT

Amorphous phases are prepared by heat treatment of intermetallic compounds of Zr-Al alloys in hydrogen-containing gas.

8 Claims, 3 Drawing Figures

AMORPHIZATION of Zr–Al alloys by absorbing Hz gas.

PROCESS FOR PREPARING AMORPHOUS PHASES OF INTERMETALLIC COMPOUNDS BY A CHEMICAL REACTION

BACKGROUND OF THE INVENTION

1. Field of the Invention

The present invention relates to a process for preparing amorphous phases of metals useful in material engineering. More particularly, the present invention relates to a process for preparing amorphous phases of intermetallic compounds by a chemical reaction.

2. Description of the Prior Art

Amorphous metals are of interest as new materials rich in functional properties in wide fields of engineering because of their excellent physical and chemical properties.

For production of these morphous metals, two methods have been established: rapid cooling of liquid metal and vapor deposition of metal. Of these methods, the method of rapid cooling of liquid metal has become a main pathway recently and is able to provide an amorphous metal. Further, by the method of vapor deposition of metal, the metal vapor which is produced by heating and evaporating the metal in vacuo is applied onto a substrate maintained at the temperature of liquid helium or liquid nitrogen to obtain the amorphous metal.

The method of rapid cooling of liquid metal has the following problems: (1) the products are limited to ribbons or line and it is impossible to amorphize a thick part of a required part, and (2) the fields of use are narrowly limited because of the difficulty in controlling the rate of rapid cooling.

Further, the method of vapor deposition is unable to prepare a thicker product than a product obtained from the method of rapid cooling of liquid, and the obtained product has a very high cost.

SUMMARY OF THE INVENTION

The present invention is a process for preparing amorphous metals by a chemical reaction with hydrogen. The process comprises the steps of adding an element such as Al to a single metal such as Zr which generally forms a tightly bonded hydride, forming intermetallic compounds and then adding hydrogen to the compound to form amorphous phases, i.e., to form hydrides of the intermetallic compounds which are amorphous.

Namely, the present invention is a process for preparing amorphous phases of the intermetallic compounds of Zr-Al alloys by heat treatment in hydrogen-containing gas so as to absorb hydrogen. According to the present invention, it is possible to prepare sufficiently thick amorphous phases having various thicknesses by the selection of the conditions of $H_2$ gas absorption.

For a better understanding of the invention, reference is made to the following detailed description of a preferred embodiment, taken in conjunction with the appended drawings.

DETAILED DESCRIPTION OF A PREFERRED EMBODIMENT

Figure 1:
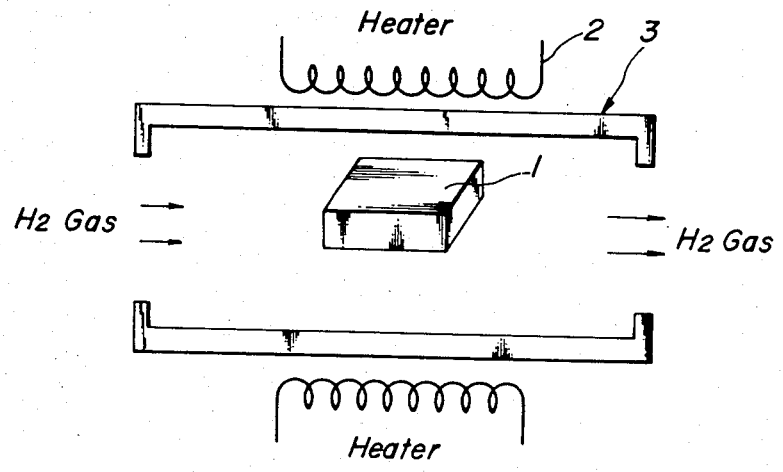
FIG. 1 is a schematic view of an electric furnace suitable for carrying out an embodiment of the present invention.

Referring to FIG. 1, crystals of intermetallic compounds 1 are treated by heating at given temperature in a hydrogen-containing gas (pure $H_2$ gas, $H_2$ gas plus an inert gas such as Ar, etc.) within an electric furnace 3 having a heater 2. The heating temperature and the heating time are variable according to the kinds and properties of the intermetallic compounds, the conditions for preparing the amorphous phases and the like. By the heat treatment, crystals 1 absorb hydrogen, and the obtained products turn to the amorphous phases by a chemical reaction between hydrogen and the other atoms of intermetallic compounds to form hydrides thereof. In this case, the reaction accelerates with rising temperature and with finely powdering the crystals. The selection of the heating temperature is also important. Effectiveness requires that the temperature be lower than that for the crystallization of the amorphous phases.

Examples of conditions for the hydrogen absorption required to form the amorphous phases are shown below.

| Material | Hydrogen pressure | Temperature of hydrogen absorption | Time of hydrogen absorption |
|---|---|---|---|
| $Zr_3Al$ | 1 atm | 350° K.–650° K. | 900 sec |
| $Zr_2Al$ | 1 atm | 400° K.–700° K. | 1,800 sec |

The thicknesses of amorphous phases are freely controlled by controlling the hydrogen pressure of the surrounding gas, the temperature of hydrogen absorption and the time of hydrogen absorption.

The following examples are intended to illustrate this invention without limiting the scope thereof.

EXAMPLE 1

Figure 2:
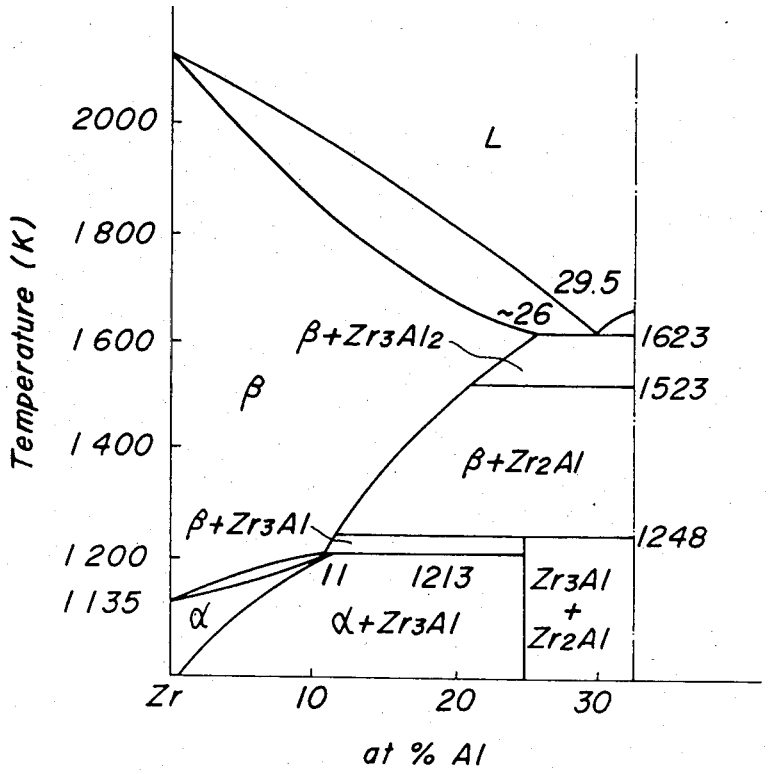
FIG. 2 is a phase diagram of Zr-Al alloys suitable for carrying out an embodiment of the present invention.
Figure 3A:
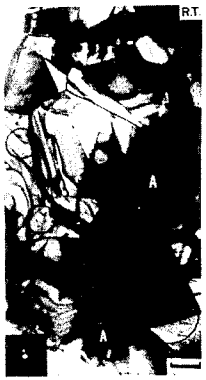
FIG. 3 is a sectional view of crystal structures photographed with an electron microscope before and after hydrogen absorption by Zr-Al alloys of an embodiment of the present invention.
Figure 3B:
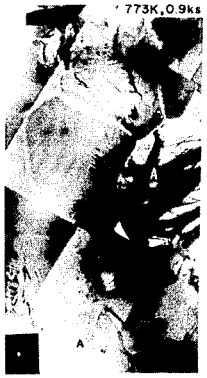
Figure 3C:
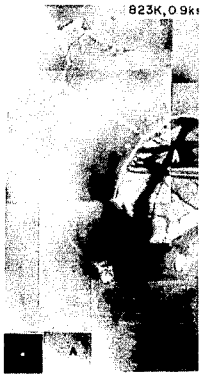
Figure 3D:
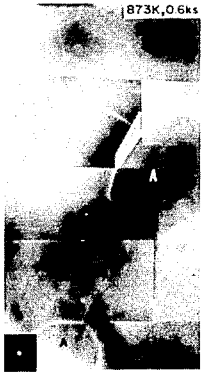

30 at % of aluminium and 70 at % of sponge zirconium were subjected to arc welding to form Zr-Al alloys. A phase diagram of the alloys is shown in FIG. 2.

The alloy plate was then cut into thin films having thicknesses of 0.2 mm with a discharge processing machine and electro-polished in a solution containing 9 parts of acetic acid and 1 part of perchloric acid to obtain a sample for an electron microscope. This sample was heat-treated at heating temperatures and heating times of 773° K.×0.9 Ks, 823° K.×0.9 Ks and 873° K.×0.6 Ks, successively, in an electric furnace having a surrounding gas of 0.1 MPa of Ar+10% $H_2$ so as to absorb hydrogen. Each time the sample was subjected to heat treatment at each heating temperature, the sample was cooled to room temperature and the same portion thereof observed within the same range of the electron microscope.

FIG. 3 shows the results. FIG. 3(*a*) shows a photograph of the structures before the hydrogen absorption. FIGS. 3(*b*), (*c*) and (*d*) show photographs of the structures after heat treatment under the given conditions. In these photographs, crystal particles noted by A are $Zr_2Al$ and the other parts are $Zr_3Al$. From these photographs, it may be recognized that the whole $Ar_3Al$ part changes the amorphous phases when hydrogen absorption is accelerated. By comparing (c) and (d), one may concluded that the reaction rate of $Zr_3Al$ is faster than that of $Zr_2Al$.

EXAMPLE 2

Zr-Al alloys (Zr-$Zr_3Al$ and $Zr_3Al$-$Zr_2Al$) were electro-polished to obtain samples in the same way described in the above example 1. The obtained samples were heat-treated at heating temperatures of 470° K.–873° K. and heating times of 0.9ks–1.8ks in a surrounding gas which contained $H_2$ at 1 atm. The samples were then cooled and observed within the same range of the electron microscope, respectively. The amorphization was recognized by observation of the sample changes due to hydrogen absorption.

Summarizing the results of these examples: (1) By hydrogen absorption by Zr-Al alloys, amorphous phases are obtained. (2) By repetition of the hydrogen absorption, sufficient amorphous phases are observed. (3) The amorphous phases of $Zr_3Al$ are easier to obtain than those of $Zr_2Al$. (4) The amorphization proceeds from a thin edge of the sample, and preferentially at regions having lattice defects such as grain boundaries and dislocations. (5) Neither of the amorphous Zr-Al alloys crystallize by simple annealing in vacuo at higher temperatures than the temperatures for heat treatment for hydrogen absorption.

Since the present invention is directed to hydrogen absorption which changes crystals into amorphous phases, amorphous products having sufficient thickness (1 cm or more) are obtained by the selection of conditions for hydrogen absorption. This process is original because no thick amorphous products are obtained by conventional methods.

According to the present invention, we may expect the following advantages:

(1) Possibility of thickness control of the amorphous regions by controlling the conditions of hydrogen absorption.

(2) Availability of amorphous phases from any form, including extremely complex forms prepared by other methods.

(3) Stability of the amorphous phases over a wide range of temperatures.

(4) Preparation of finely ground amorphous powder by grinding the obtained amorphous materials.

(5) Preparation of finely ground powder from which hydrogen is released by heating the amorphous materials at a higher temperature than the temperature of crystallization.

(6) Repeating use of the amorphous materials as the alloys for hydrogen absorption from which hydrogen is released at a given temperature by using the nature of the amorphous materials which have constant temperatures of crystallization.

Consequently, the present invention has the following uses:

(1) Preparation of amorphous materials having sufficient thicknesses.

(2) Amorphization of surface phases or whole phases having complex forms obtained by other means.

(3) Preparation of a superfine ground powder.

(4) Hydrogen absorption using the solid from which hydrogen is released at a given temperature.

What is claimed is:

1. A process for preparing amorphous hydrides of intermetallic compounds by a chemical reaction, said process comprising:

a. alloying a mixture consisting essentially of zirconium and aluminum to form intermetallic compounds thereof; and b. reacting said intermetallic compounds at an elevated temperature in a reaction chamber with a gas including hydrogen gas to produce amorphous hydrides of said intermetallic compounds, said elevated temperature ranging from a temperature effective to cause said chemical reaction to a temperature which does not equal or exceed the temperature at which said amorphous hydrides crystallize.

2. A process according to claim 1, wherein said mixture contains from 1 to 32 atomic % aluminum.

3. A process according to claim 2, including the further step of grinding the intermetallic compounds formed in the alloying step into a fine powder prior to the reacting step.

4. A process according to claim 2, wherein said elevated temperature does not exceed 873° K.

5. A process according to claim 2, wherein said elevated temperature ranges from 350° to 873° K.

6. A process according to claim 2, wherein said gas passes through said reaction chamber and has a pressure for hydrogen of up to about 1 atm.

7. A process according to claim 2, wherein the reacting step has a heating time of from 10 to 30 minutes.

8. Amorphous hydrides of intermetallic compounds prepared by a process comprising:

a. alloying a mixture consisting essentially of zirconium and aluminum to form intermetallic compounds thereof; and b. reacting said intermetallic compounds at an elevated temperature in a reaction chamber with a gas including hydrogen gas to produce amorphous hydrides of said intermetallic compounds, said elevated temperature ranging from a temperature effective to cause a chemical reaction to a temperature which does not equal or exceed the temperature at which said amorphous phases crystallize.

* * * * *